United States Patent [19]

Mizuno

[11] Patent Number: 4,970,561

[45] Date of Patent: Nov. 13, 1990

[54] MULTI-COLOR DEVELOPING DEVICE HAVING A RETRACTABLE MECHANISM FOR AN IMAGE FORMING APPARATUS

[75] Inventor: Masayuki Mizuno, Osaka, Japan

[73] Assignee: Mita Industrial Co., Ltd., Osaka, Japan

[21] Appl. No.: 400,439

[22] Filed: Aug. 30, 1989

[30] Foreign Application Priority Data

Aug. 31, 1988 [JP] Japan ..... 63-219297

[51] Int. Cl.[5] ..... G03G 15/01

[52] U.S. Cl. ..... 355/326; 74/354

[58] Field of Search ..... 355/245, 326; 118/645; 74/354, 380

[56] References Cited

U.S. PATENT DOCUMENTS

| | | | |
|---|---|---|---|
| 4,203,386 | 5/1980 | Blöchl et al. | 355/245 X |
| 4,383,778 | 5/1983 | Costa | 74/354 X |
| 4,710,016 | 12/1987 | Waatanable | 355/326 |

FOREIGN PATENT DOCUMENTS

| | | | |
|---|---|---|---|
| 0201272 | 9/1986 | Japan | 355/245 |
| 62-134654 | 6/1987 | Japan | |
| 0208074 | 9/1987 | Japan | 355/245 |

*Primary Examiner*—A. T. Grimley
*Assistant Examiner*—J. E. Barlow, Jr.
*Attorney, Agent, or Firm*—Armstrong, Nikaido, Marmelstein, Kubovcik & Murray

[57] ABSTRACT

A multi-color developing device for an image forming apparatus having: a first developing unit retractable with respect to a photosensitive drum; a second developing unit adjacent to the first developing unit and retractable with respect to the photosensitive drum; a cam mechanism for bringing either one of the first or second developing units to a position remote from the photosensitive drum when the other one, either the first or second developing units is positioned adjacent to the photosensitive drum; a pair of driving gears provided between the first and second developing units for receiving power to drive the respective developing units; a first joint gear which engages one of the driving gears to transmit power to the first developing unit; a second joint gear which engages the other one of the driving gears to transmit power to the second developing unit; a first joint member which rotatably supports the first joint gear and which moves the first joint gear to the position to engage with or disengage from the corresponding driving gear in synchronization with the moving of the first developing unit close to or away from the photosensitive drum; and a second joint member which rotatably supports the second joint gear and which moves the second joint gear to the position to engage with or disengage from the corresponding driving gear is synchronization with the moving of the second developing unit cloe to or away from the photosensitive drum.

7 Claims, 5 Drawing Sheets

MULTI-COLOR DEVELOPING DEVICE HAVING A RETRACTABLE MECHANISM FOR AN IMAGE FORMING APPARATUS

BACKGROUND OF THE INVENTION

1. Field of the invention

This invention relates to a multi-color developing device for use in an image forming apparatus, and more particularly, it relates to a multi-color developing device for an image forming apparatus in which a plurality of developing units are disposed retractably with respect to a photosensitive drum.

2. Description of the prior art

A conventional two-color developing device for an image forming apparatus comprises: a pair of developing units disposed retractably with respect to a photosensitive drum; a cam mechanism for bringing either one of the developing units to a retracted position away from the photosensitive drum when the other one of the developing units is positioned in a developing position adjacent to the photosensitive drum; a pair of driving units for driving the respective developing units; driving gears provided in the respective driving units; and joint gears provided in the respective developing units and engaged with the corresponding driving gears to transmit power to the respective developing units. The joint gear in each developing unit is constantly engaged with the corresponding driving gear whether the developing unit is in the developing position adjacent to the photosensitive drum or in the retracted position away therefrom. Also, in each of the driving units, a clutch is provided for disengaging transmission of power when the corresponding developing unit is in the retracted position.

In the above-mentioned conventional developing device, each joint gear is put in the proper state of engagement with the corresponding driving gear when the corresponding developing unit is positioned in the developing position adjacent to the photosensitive drum, while these gears engage with each other only by the edges of their teeth when the developing unit is positioned in the retracted position away from the photosensitive drum. That is, the joint gear gradually meshes deeper with the driving gear from the tooth edge engagement into the proper state of engagement as the developing unit leaves the retracted position remote from the photosensitive drum and moves closer to the photosensitive drum into the developing position where the developing roller in the developing unit faces the photosensitive drum with a predetermined clearance.

In the above-described construction, the joint gear and the driving gear must be manufactured so that the predetermined clearance is provided between the photosensitive drum and the developing roller in the developing unit when the gears are properly engaged, thus requiring high accuracy in the finished gears. Also, in the above-mentioned conventional construction, since the gears are constantly engaged with each other, the developing unit can be moved only within the range of the gear engagement, thus limiting the travelling stroke of the developing unit. Furthermore, in the above-mentioned conventional construction, since the joint gear in each developing unit is constantly engaged with the corresponding driving gear, it is necessary to provide a clutch in each driving unit for disengaging transmission of power from the driving unit to the developing unit.

SUMMARY OF THE INVENTION

The multi-color developing device for an image forming apparatus of this invention, which overcomes the above-discussed and numerous other disadvantages and deficiencies of the prior art, comprises: a first developing unit retractable with respect to a photosensitive drum; a second developing unit adjacent to the first developing unit and retractable with respect to the photosensitive drum; a cam mechanism for bringing either one of the first or the second developing unit to a position remote from the photosensitive drum when the other one, either the first or the second developing unit, is positioned adjacent to the photosensitive drum; a pair of driving gears provided between the first and second developing units for receiving power to drive the respective developing units; a first joint gear which engages one of the driving gears to transmit power to the first developing unit; a second joint gear which engages the other one of the driving gears to transmit power to the second developing unit; a first joint member which rotatably supports the first joint gear and which moves the first joint gear to the position to engage with or disengage from the corresponding driving gear in synchronization with the moving of the first developing unit close to or away from the photosensitive drum; and a second joint member which rotatably supports the second joint gear and which moves the second joint gear to the position to engage with or disengage from the corresponding driving gear in synchronization with the moving of the second developing unit close to or away from the photosensitive drum.

In a preferred embodiment, each of the first and the second developing units is supported on a corresponding supporting member which is retractable with respect to the photosensitive drum.

In a preferred embodiment, each of the first and second joint members is swingably supported on the corresponding supporting member.

In a preferred embodiment, an urging means for urging each of the first and second joint gears to engage the corresponding driving gear is disposed between each of the first and second joint members and the corresponding supporting member.

In a preferred embodiment, each of the first and second joint members is swung, abutting against a corresponding abutting member and resisting the urging force of the urging means, to disengage the first or second joint gear from the corresponding driving gear when the first or the second developing unit, whichever applicable, is moved to a position remote from the photosensitive drum by the action of the corresponding supporting member.

In a preferred embodiment, each of the first and second joint members is positioned so that each of the first and second joint gears is put in the proper state of engagement with the corresponding driving gear when these gears are made to engage with each other.

In a preferred embodiment, each of the first and second developing units is mounted in and removed from the body of the image forming apparatus by sliding in the axial direction of the photosensitive drum.

In a preferred embodiment, the body of the image forming apparatus is provided with guide rails extending in the axial direction of the photosensitive drum for guiding the first and second developing units, respectively, each developing unit having a slide which engages the corresponding guide rail, the slide being movable with respect to the guide rail in both directions to close and widen the distance to the photosensitive drum when the developing unit is mounted in the body of the image forming apparatus.

Thus, the invention described herein makes possible the objectives of (1) providing a multi-color developing device for an image forming apparatus in which only the selected developing unit can be driven without using a clutch for each developing unit, thereby simplifying the construction of the driving system; (2) providing a multi-color developing device for an image forming apparatus in which the joint gear provided in the developing unit becomes completely disengaged from the corresponding driving gear when the developing unit is positioned in the retracted position away from the photosensitive drum, so that a longer stroke for travelling of the developing unit can be provided; (3) providing a multi-color developing device for an image forming apparatus in which, when the developing unit is positioned in the developing position adjacent to the photosensitive drum, the joint gear is put in the proper state of engagement with the driving gear, so that the positional relationship between the joint gear and the driving gear can be set independently of the clearance between the developing roller in the developing unit and the photosensitive drum, thereby permitting highly accurate setting of the gear engagement as well as of the clearance between the developing roller and the photosensitive drum; and (4) providing a multi-color developing device for an image forming apparatus in which the developing unit is easily removable from the body of the image forming apparatus, so that the developing unit can be readily replaced, for example, with one of a different color.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
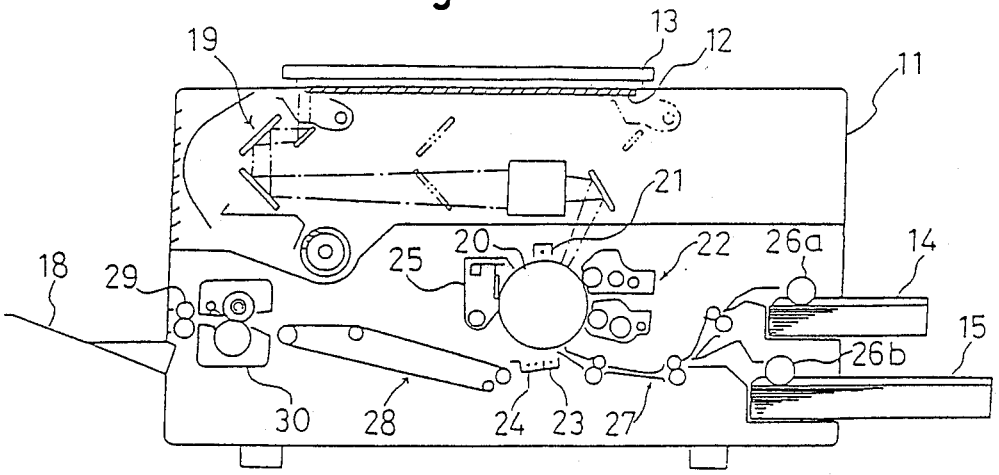
FIG. 1 is a schematic diagram showing a vertical section of an image forming apparatus employing a multi-color developing device of this invention.

FIG. 1 is a diagram showing the general construction of an electrophotographic copying machine having a multi-color developing device of this invention. Fixed to the top surface of the body 11 of the copying machine is an original stand 12. Over the original stand 12, a cover 13 is mounted which is opened and closed. Paper cassettes 14 and 15 are detachably mounted on one side of the body 11 of the copying machine. Mounted on the other side of the body 11 of the copying machine is a paper exit tray 18 for receiving sheets of paper on which an image is copied.

In the upper portion of the body 11, an optical system 19 is disposed for scanning an original document, the optical system 19 comprising a light source, a mirror, and the like. Disposed in the center of the body 11 is a photosensitive drum 20 on which an electrostatic latent image is formed. Around the photosensitive drum 20, there are disposed a charging unit 21 for charging the photosensitive drum 20 with a given amount of charge, a multi-color developing device 22 for developing with toner the electrostatic latent image formed on the photosensitive drum 20, a transfer unit 23 for transferring the toner image onto a copy sheet, a separating unit 24 for separating the copy sheet from the photosensitive drum 20, and a cleaning unit 25 for removing the remaining toner on the photosensitive drum 20.

Paper feed rollers **26*a* and 26*b* are respectively disposed above the portions of the body 11 to which the paper cassettes 14 and 15 are attached. Between the paper cassettes 14 and 15 and an image forming section comprising the photosensitive drum 20 and other components, is disposed a transport path 27 on the paper feed side for transporting the copy sheet, while another transport path 28 on the paper exit side is disposed downstream of the image forming section. Disposed between the transport path 28 on the paper exit side and a paper exit roller 29 is a fixing unit 30** for fixing the transferred image on the copy sheet thereto when the sheet is transported.

Figure 2:
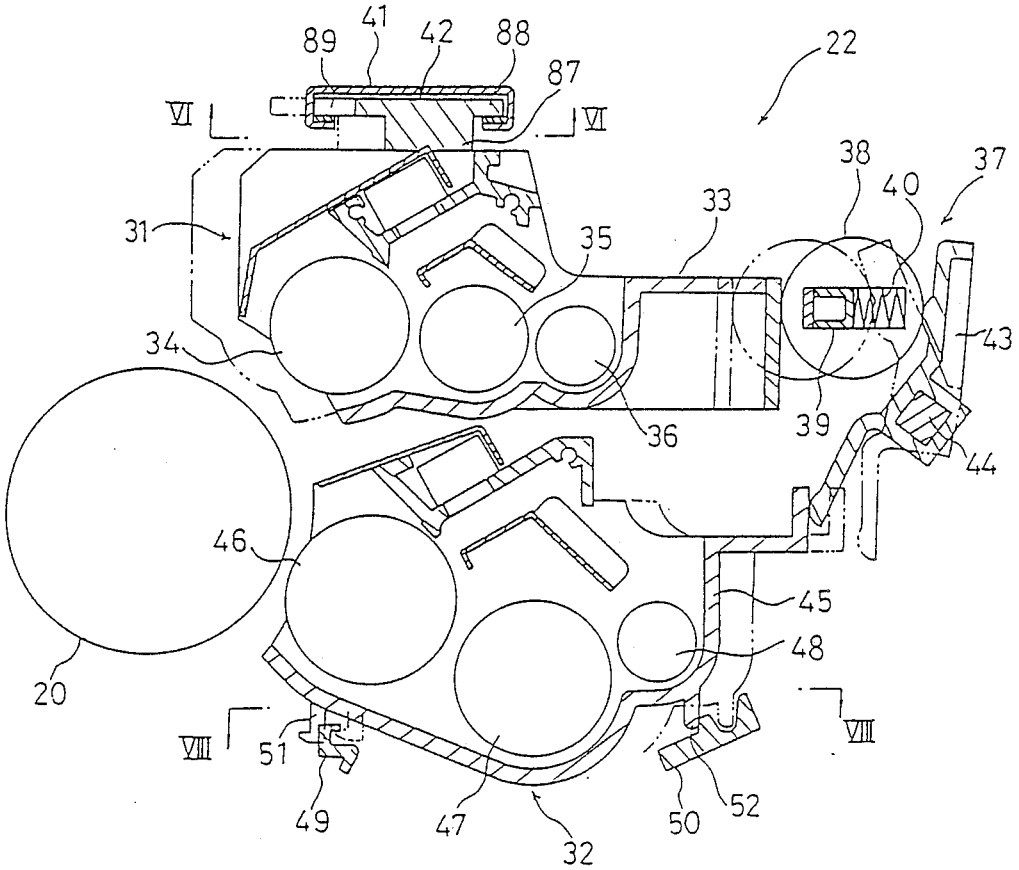
FIG. 2 is a vertical sectional view of the multi-color developing device of this invention.

The multi-color developing device 22 comprises, as shown in FIG. 2, a first developing unit 31, a second developing unit 32 disposed thereunder, and a cam mechanism 37 for moving the developing units 31 and 32.

The first developing unit 31 comprises a casing 33, and a first developing roller 34, a delivery roller 35 and a stirring roller 36, respectively disposed inside the casing 33. The first developing roller 34 is used to develop the latent image formed on the surface of the photosensitive drum 20 by applying toner thereto. On the upper end of the first developing unit 31 is provided a slide 42 which engages a guide rail 41 extending orthogonally to the paper transport direction.

Abutting against the first developing unit 31 is a disc-shaped cam 38 of the cam mechanism 37, the cam 38 having a diametrically extending rectangular opening in its center. The opening engages a driving shaft 39, and the cam 38 is movable along the length of the opening. The driving shaft 39 is made to rotate in steps of 180 degrees by a control means not shown. Inside the opening of the cam 38 is provided a spring 40 for pushing the driving shaft 39 to one side of the opening. Abutting against the cam 38 is the upper end of a follower 43 the center portion of which is supported on a fulcrum 44, the follower 43 being swingable on the fulcrum 44. The follower 43 has its upper end abutting against the cam 38, the upper end facing the first developing unit 31 with the cam 38 interposed therebetween.

The second developing unit 32 comprises a casing 45, and a second developing roller 46, a delivery roller 47 and a stirring roller 48, respectively disposed inside the casing 45. The second developing roller 46 is used to develop the latent image formed on the surface of the photosensitive drum 20 by applying toner thereto. On the side edges of the underside of the casing 45, there are formed a pair of slides 51 and 52, the slides 51 and 52 engaging a pair of guide rails 49 and 50 extending orthogonally to the paper transport direction, respectively.

Figure 3:
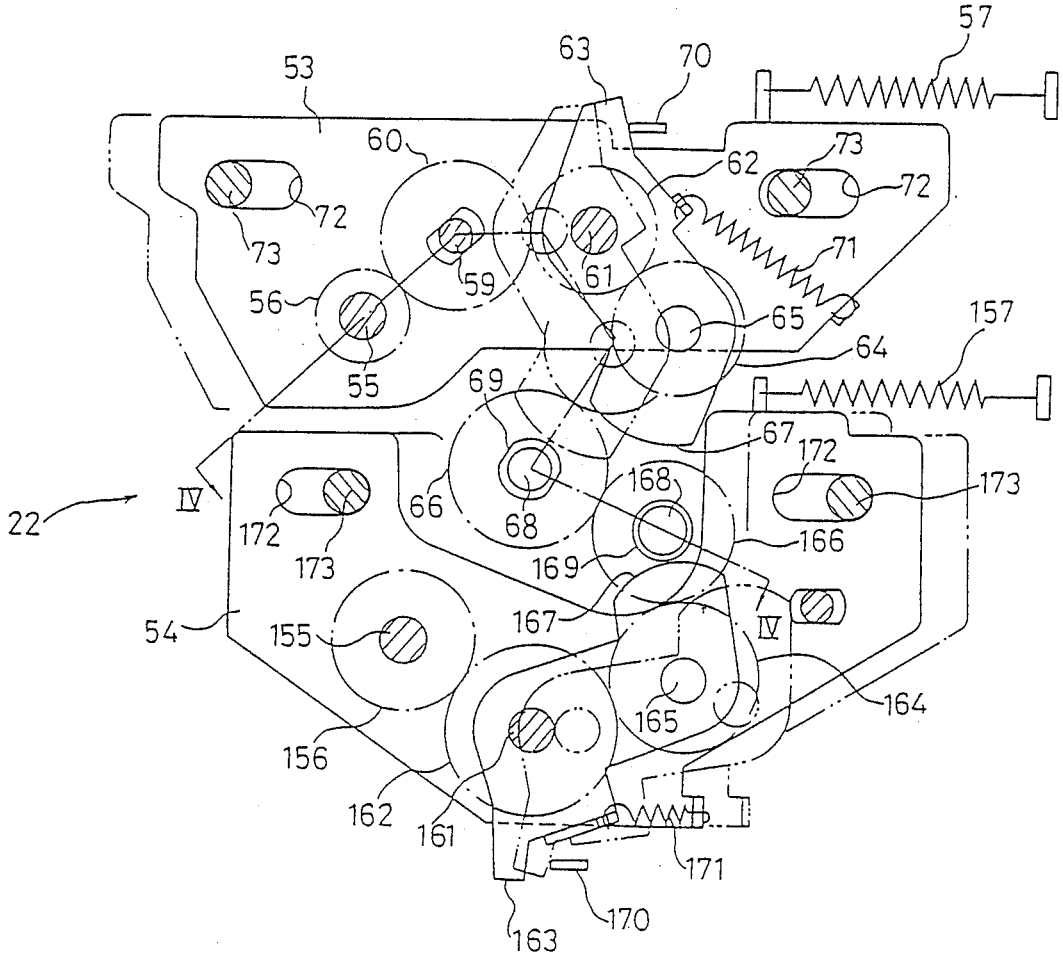
FIG. 3 is a schematic diagram showing the construction of a driving system on the rear side of the multi-color developing device shown in FIG. 2.

As shown in FIG. 3, on the side of the multi-color developing device 22 close to the rear end face of the body 11, a flat supporting side plate 53 for supporting the first developing unit 31 is mounted in the upper section thereof, while in the lower section, a flat supporting side plate 54 for supporting the second developing unit 32 is mounted. The upper supporting side plate 53 is provided with a pair of horizontally elongated holes 72 in the upper corners thereof. The elongated holes 72, respectively, are slidably engaged with a pair of pins 73 provided in a side wall 58 (FIG. 4) along the rear end face of the body 11, thus allowing the side plate 53 to move in the horizontal direction.

A center shaft 55 mounted through the axis of the first developing roller 34 (FIG. 2) engages the side plate 53 in a rotatable and removable way. A developing roller gear 56 is fixed to the center shaft 55. Further, a spring 57 is disposed in a stretched state between the side plate 53 and an appropriate member of the body 11, the spring 57 constantly exerting force to pull the side plate 53 away from the photosensitive drum 20.

Figure 4:
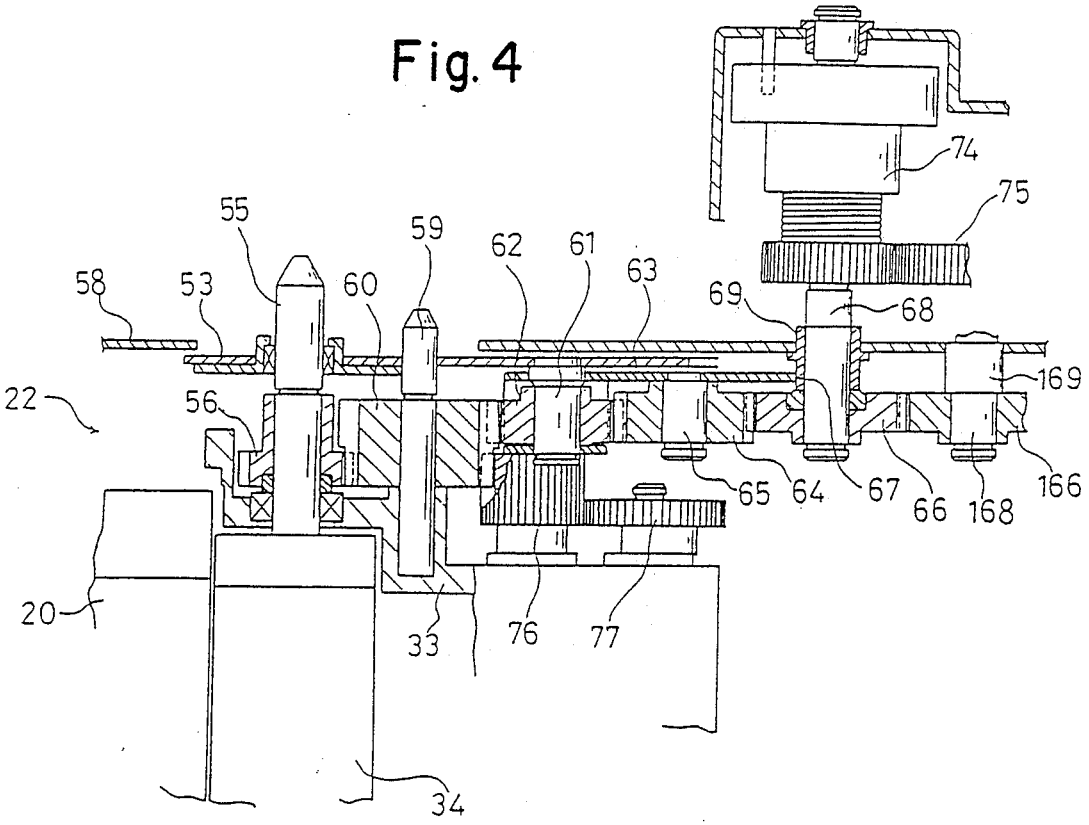
FIG. 4 is a sectional view taken along the line IV—IV of FIG. 3.

As shown in FIG. 4, the side plate 53 is disposed along the side wall 58 along the rear end face of the body 11. Also, in the casing 33 of the first developing unit 31, a supporting shaft 59 is disposed running in parallel with the center shaft 55 of the developing roller 34 and protruding through the rear side of the first developing unit 31, the supporting shaft 59 engaging an elongated hole formed in the side plate 53. A gear 60 is rotatably mounted on the supporting shaft 59, the gear 60 engaging the developing roller gear 56. To the side plate 53 is fixed an end of a supporting shaft 61 adjacent to the supporting shaft 59, the supporting shaft 61 rotatably supporting a gear 62 which engages the gear 60. Also engaged with the gear 60 is a gear 76 positioned on the side of the gear 62 nearer to the first developing unit 31, as shown in FIG. 4. The gear 76 is fixed to the delivery roller 35. Engaged with the gear 76 is a gear 77 fixed to the stirring roller 36.

As shown in FIG. 3, between the side plate 53 and the gear 62 on the supporting shaft 61, a vertical joint plate 63 is fitted swingably about the supporting shaft 61. The joint plate 63 is formed in a vertically long shape, to the lower part of which is fixed a supporting shaft 65 which rotatably supports a joint gear 64. Between the upper side plate 53 and the lower side plate 54, a driving gear 66 is disposed, being supported on a supporting shaft 68 and adjacent to the side of the lower portion of the joint plate 63 nearer to the photosensitive drum 20. The joint gear 64 is disengaged from the driving gear 66 when the lower portion of the joint plate 63 is positioned away from the photosensitive drum 20 as shown by a solid line in FIG. 3. On the other hand, the joint gear 64 engages the driving gear 66 when the lower portion of the joint plate 63 is positioned close to the photosensitive drum 20 as shown by a two-dot chain line. On the lower end face of the joint plate 63 is formed an abutting portion 67 capable of abutting against a sleeve 69 mounted on the supporting shaft 68 supporting the driving gear 66. The abutting portion 67 is made to abut against the sleeve 69 when the joint gear 64 engages the driving gear 66 as shown by the two-dot chain line, thus holding the joint gear 64 and the driving gear 66 in a properly engaged state. The upper end portion of the joint plate 63 is made to abut against an adjacent abutting member 70 provided on an appropriate member in the body 11. Between the upper portion of the joint plate 63 and the side plate 53, a spring 71 is disposed in a stretched state, the resilience of the spring 71 constantly exerting pulling force to make the upper portion of the joint plate 63 abut against the abutting member 70.

As shown in FIG. 4, the supporting shaft 68 supporting the driving gear 66 is connected via a spring clutch 74 to a gear 75 which is driven by a driving source (not shown) disposed in the body 11.

The spring clutch 74 disengages the transmission of power from the driving source to the driving gear 66 when the side plate 53 or 54 moves in the horizontal direction, thus facilitating the movement of the side plate 53 or 54.

The second developing unit 32 has essentially the same construction in the supporting side plate 54 as that of the first developing unit 31. The supporting side plate 54 is provided with a pair of horizontally elongated holes 172 in the upper corners thereof. The elongated holes 172 respectively, are slidably engaged with a pair of pins 173 provided in the side wall 58 (FIG. 4) along the rear end face of the body 11, thus allowing the side plate 54 to move in the horizontal direction.

A center shaft 155 mounted through the axis of the second developing roller 46 (FIG. 2) engages the side plate 54 in a rotatable and removable way. A developing roller gear 156 is fixed to the center shaft 155. Further, a spring 157 is disposed in a stretched state between the side plate 54 and an appropriate member of the body 11, the spring 157 constantly exerting force to pull the side plate 54 away from the photosensitive drum 20.

The side plate 54 is disposed on substantially the same vertical plane as the upper side plate 53. To the side plate 54 is fixed an end of a supporting shaft 161 adjacent to the developing roller gear 156, the supporting shaft 161 rotatably supporting a gear 162 which engages the developing roller gear 156.

As shown in FIG. 3, between the side plate 54 and the gear 162 on the supporting shaft 161, a vertical joint plate 163 is fitted swingably about the supporting shaft 161. The joint plate 163 is formed in a vertically long shape, to the upper portion of which is fixed a supporting shaft 165 which rotatably supports a joint gear 164. Between the upper side plate 53 and the lower side plate 54 and upwardly of the joint plate 163, a driving gear 166 is disposed which is supported on a supporting shaft 168. The joint gear 164 is disengaged from the driving gear 166 when the upper portion of the joint plate 163 is positioned away from the photosensitive drum 20 as shown by a two-dot chain line in FIG. 3. On the other hand, the joint gear 164 engages the driving gear 166 when the upper portion of the joint plate 163 is positioned nearer to the photosensitive drum 20 as shown by a solid line. On the upper end face of the joint plate 163 is formed an abutting portion 167 capable of abutting against a sleeve 169 mounted on the supporting shaft 168 supporting the driving gear 166. The abutting portion 167 is made to abut against the sleeve 169, as shown by the solid line, when the joint gear 164 engages the driving gear 166, thus holding the joint gear 164 and the driving gear 166 in a properly engaged state. The lower end portion of the joint plate 163 is made to abut against an adjacent abutting member 170 provided on an appropriate member in the body 11. Between the lower portion of the joint plate 163 and the side plate 54, a spring 171 is disposed in a stretched state, the resilience of the spring 171 constantly exerting pulling force to make the lower portion of the joint plate 163 abut against the abutting member 170.

The driving gear 166, engaged with the adjacent driving gear 66, is connected to the driving source (not shown) disposed in the body 11, the power from the driving source being transmitted via the spring clutch 74. The spring clutch 74 may be eliminated if proper urging force is provided by the springs 57 and 157.

Figure 5:
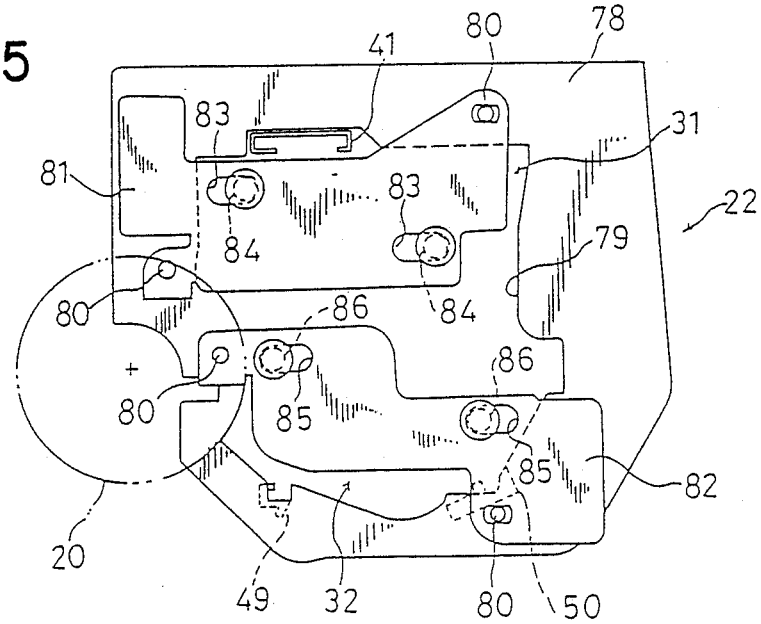
FIG. 5 is a diagram showing the construction of the front side of the multi-color developing device shown in FIG. 2.

On the side of the multi-color developing device 22 close to the front side of the body 11, a side wall 78 is disposed which is fixed to the body 11, as shown in FIG. 5. The side wall 78 is provided with an insertion opening 79 in the center thereof, through which the first developing unit 31 and the second developing unit 32 are inserted from the front side of the body 11 into the interior of the body 11. The side wall 78 is also provided with four pins 80 protruding toward the front side of the body 11. The pins 80 respectively engage the holes provided in side plates 81 and 82 disposed on the side of the first developing unit 31 and second developing unit 32 close to the front side of the body 11, thus allowing the first developing unit 31 and the second developing unit 32 to be mounted in position in the body 11 by the side plates 81 and 82. The side plate 81 is provided with a pair of horizontally elongated holes 83. The elongated holes 83 respectively engage a pair of pins 84 provided on the side of the casing 33 (FIG. 2) of the first developing unit 31 close to the front side of the body 11, the first developing unit 31 thus being supported movably in the horizontal and parallel direction. The other side plate 82 is also provided with a pair of horizontally elongated holes 85. The elongated holes 85 respectively engage a pair of pins 86 provided on the side of the casing 45 (FIG. 2) of the second developing unit 32 close to the front side of the body 11, the second developing unit 32 thus being supported movably in the horizontal and parallel direction.

Figure 6:
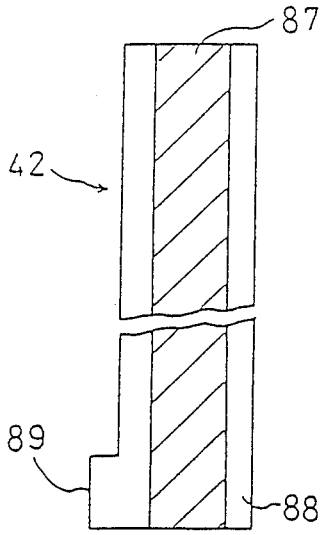
FIG. 6 is a sectional view taken along the line VI—VI of FIG. 2.
Figure 7:
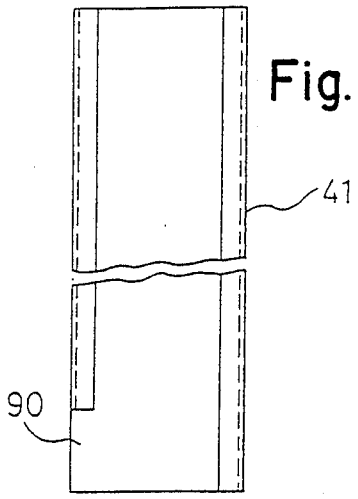
FIG. 7 is a bottom end view of a guide rail for the first developing unit of the multi-color developing device shown in FIG. 2.

Description is now given of the guide mechanism used at the time of mounting and removing the first developing unit 31. As shown in FIG. 2, the slide 42 provided on the upper end of the casing 33 of the first developing unit 31 comprises a connecting portion 87 in the lower part thereof, and an engaging portion 88 integrally formed with and on top of the connecting portion 87. The engaging portion 88 has a shape extending outwardly of the sides of the connecting portion 87. Also, as shown in FIG. 6, the side of the engaging portion 88 nearer to the photosensitive drum 20 is provided in its innermost portion to the rear of the body 11 with a protruding portion 89 (the lower end in FIG. 6) protruding to one side. On the other hand, the guide rail 41 shown in FIG. 2 is fixed to the body 11. The guide rail 41 has a C-shaped cross section with a downwardly open end, and extends in the axial direction of the photosensitive drum 20. The hollow space of the guide rail 41 is provided with an appropriate size to allow the engaging portion 88 of the slide 42 to be slidably engaged, while the open end in the lower portion of the guide rail 41 is provided with an appropriate width to allow the connecting portion 87 to pass therealong with appropriate play. The engaging portion 88 and the protruding portion 89 engage the lower surface of the guide rail 41 for sliding thereon. As shown in FIG. 7, the lower surface and side surface of the guide rail 41 nearer to the photosensitive drum 20 are cut out in the innermost portion thereof to the rear of the body 11 to form a cut-out portion 90. The cut-out portion 90 is provided with an appropriate size to allow the protruding portion 89 of the slide 42 to protrude outwardly when the entire slide 42 is fully engaged with the entire guide rail 41.

Figure 8:
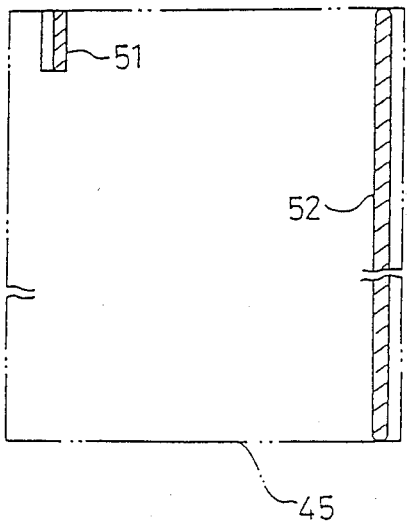
FIG. 8 is a sectional view taken along the line VIII—VIII of FIG. 2.
Figure 9:
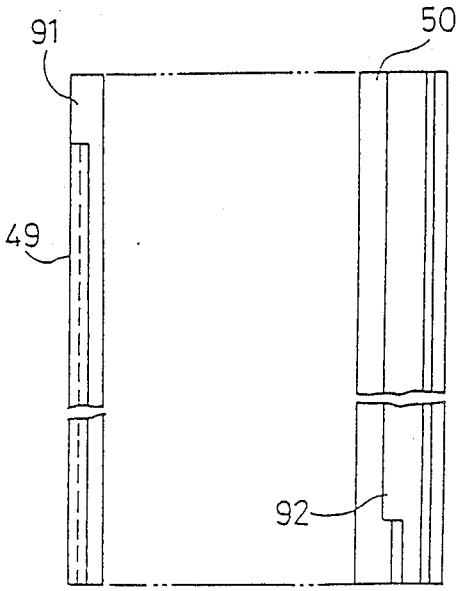
FIG. 9 is a plan view of a guide rail for the second developing unit of the multi-color developing device shown in FIG. 2.

The guide mechanism used at the time of mounting and removing the second developing unit 32 is now described. The slides 51 and 52 formed on the side edges of the underside of the second developing unit 32 extend in such a way that they can guide the casing 45 of the second developing unit 32 in the axial direction of the second developing roller 46. As shown in FIG. 8, the slide 51 is provided only on the innermost inner portion of the casing 45, and is formed in a crook shape, the lower edge thereof extending toward the photosensitive drum 20 (FIG. 2). As shown in FIG. 2, the crooked portion of the slide 51 engages the upper portion of the guide rail 49 having a U-shaped cross section. The guide rail 49 is fixed to the body 11, and, as shown in FIG. 9, has a cut-out portion 91 formed in the side thereof nearer to the photosensitive drum 20 and to the innermost portion of the body 11. The cut-out portion 91 engages the slide 51 when the second developing unit 32 is set in the body 11.

As shown in FIG. 8, the slide 52 formed on the remote side of the casing 45 of the second developing unit 32 from the photosensitive drum 20 extends in a straight line, the lower end thereof slidably engaging a guide groove 92 of the guide rail 50 shown in FIG. 2. As shown in FIG. 9, the guide groove 92 is provided with a width that approximately matches that of the slide 52 along the portion thereof nearer to the front side of the body 11, and the inside wall of the guide groove 92 is eliminated inwardly of that portion. Thus, when the second developing unit 32 is set in the body 11, the slide 52 is movable sideward of the guide groove 92 where the inside wall is eliminated.

The following will describe the operations of the electrophotographic copying machine of the above-mentioned construction.

When a copy command is given, the photosensitive drum 20 starts to rotate, and the surface thereof is uniformly charged by means of the charging unit 21. Next, the original document placed on the original stand 12 is scanned by the optical system 19, the light reflected from the original document being projected onto the photosensitive drum 20 to form a latent image thereon. The latent image is then developed into a toner image on the photosensitive drum 20 by means of the multi-color developing device 22. The operations of the multi-color developing device 22 will be described later in detail.

In the meantime, the copy sheet accommodated in the paper cassette 14 or 15 is passed through the transport path 27 on the paper feed side, and is fed to the image forming section comprising the photosensitive drum 20 and other components, where the toner image is transferred onto the predetermined position on the copy sheet. The copy sheet with the toner image transferred thereon is transported through the transport path 28 on the paper exit side to the fixing unit 30 where the toner image is fixed onto the copy sheet. The copy sheet with the toner image fixed thereon is discharged onto the paper exit tray 18 by means of the paper exit roller 29.

In the multi-color developing device 22, the following operation is performed when switching over between the first developing unit 31 and the second developing unit 32 for changing toner colors, etc.

FIG. 2 shows the state in which the lower second developing unit 32 is in the developing position while the upper first developing unit 31 is in the retracted position. From the state of FIG. 2, to change the first developing unit 31 to the developing position and the second developing unit 32 to the retracted position, the spring clutch 74 is disengaged to allow the driving shaft 39 to rotate by 180 degrees. This makes the cam 38 rotate to move the first developing unit 31 into the developing position shown by the two-dot chain line, thus bringing the first developing roller 34 of the first developing unit 31 in the predetermined position with respect to the photosensitive drum 20. When the first developing unit 31 is positioned in the predetermined developing position with respect to the photosensitive drum 20, the spring 40 disposed inside the cam 38 is compressed to absorb the force acting on the first developing unit 31. Also, since the protruding portion 89 of the slide 42 is allowed to pass through the cut-out portion 90 of the guide rail 41, there arises no possibility of the guide rail 41 interfering with the movement of the first developing unit 31. In the meantime, since the pressing force of the cam 38 is released, the second developing unit 32 is moved away from the photosensitive drum 20 into the retract position shown by the two-dot chain line by means of the spring force of the spring 157.

When the first developing unit 31 and the second developing unit 32 are thus moved as shown in FIG. 2, the upper joint plate 63 disengages from the abutting member 70, and is swung by the spring force of the spring 71 so that the lower portion thereof moves closer to the photosensitive drum 20, as shown by the two-dot chain line in FIG. 3, thereby causing the joint gear 64 to engage the driving gear 66 and the abutting portion 67 of the joint plate 63 to abut against the sleeve 69. Thus, the joint gear 64 is made to properly engage the driving gear 66 in the proper position. As a result, the rotating force of the driving gear 66 is transmitted to the developing roller gear 56 via the joint gear 64, the gear 62, and the gear 60, thus putting the first developing unit 31 into an operating condition with the first developing roller, etc. rotating. On the other hand, when the second developing unit 32 is moved away from the photosensitive drum 20, the lower end portion of the lower joint plate 163 is brought to abut against the abutting member 170. As a result, the joint plate 163 is swung about the supporting shaft 161 so that the upper portion thereof moves away from the photosensitive drum 20, and is positioned as shown by the two-dot chain line in FIG. 3. This causes the joint gear 164 to disengage from the driving gear 166, thereby disabling transmission of the rotating force of the driving gear 166 to the center shaft 155 and putting the second developing unit 32 into nonoperating condition with the developing roller 46, etc. at rest. In this case, since the joint gear 164 becomes completely disengaged from the driving gear 166, it is possible to provide a sufficient stroke for travelling of the second developing unit 32.

Next, from the state in which the first developing unit 31 is in an operating condition and the second developing unit 32 is in non-operating condition, to change the first developing unit 31 to non-operating condition and the second developing unit 32 to an operating condition, the spring clutch 74 is disengaged to allow the driving shaft 39 to rotate by 180 degrees once again. This makes the first developing unit 31 move away from the photosensitive drum 20 into the retracted position shown by the solid line in FIG. 3, which movement causes the upper end portion of the upper joint plate 63 to abut against the abutting member 70. As a result, the joint plate 63 is swung about the supporting shaft 61 so that the lower portion thereof moves away from the photosensitive drum 20, and is positioned as shown by the solid line in FIG. 3. This causes the joint gear 64 to disengage from the driving gear 66, thereby disabling transmission of the rotating power of the driving gear 66 to the center shaft 55 and putting the first developing unit 31 into a non-operating condition. In this case, since the joint gear 64 becomes completely disengaged from the driving gear 66, it is possible to provide a sufficient stroke for travelling of the first developing unit 31. In the meantime, since the second developing unit 32 is moved toward the photosensitive drum 20 by the action of the cam mechanism 37, the lower joint plate 163 is released from the control of the abutting member 170. As a result, the joint plate 163 is swung by the spring force of the spring 171 so that the upper end portion thereof moves closer to the photosensitive drum 20, and is positioned as shown by the solid line in FIG. 3. This causes the joint gear 164 mounted on the joint plate 163 to engage the driving gear 166, and the abutting portion 167 of the joint plate 163 to abut against the sleeve 169. Thus, the joint gear 164 is made to properly engage the driving gear 166 in the proper position. This engagement of the gears allows the rotating force of the driving gear 166 to be transmitted from the driving gear 166 to the developing roller gear 156 via the joint gear 164 and the gear 162, thus putting the second developing unit 32 into an operating condition. Also, when the second developing unit 32 is moved to the predetermined developing position, the spring 40 disposed inside the cam 38 is compressed to absorb the force acting on the second developing unit 32, thus providing the predetermined clearance between the photosensitive drum 20 and the second developing roller 46. In the above-described movement, since the slide 51 is allowed to pass through along the cut-out portion 91 of the guide rail 49 while the slide 52 moves sideward of the guide groove 92, there arises no possibility of the guide rails 49 and 50 interfering with the movement of the second developing unit 32.

To remove the first developing unit 31, the first developing unit 31 is placed in the retracted position remote from the photosensitive drum 20 so that the protruding portion 89 of the slide 42 is engaged with the guide rail 41. Then, by pulling the side plate 81 shown in FIG. 5 toward the front side, the entire first developing unit 31 is drawn out toward the front side with the slide 42 sliding while being guided by the guide rail 41. On the other hand, to mount a fresh first developing unit 31 in the body 11, the slide 42 is made to engage the guide rail 41, and the first developing unit 31 is inserted through the insertion opening 79 provided in the side wall 78. As the first developing unit 31 is further inserted, the center shaft 55 and supporting shaft 59 of the first developing unit 31 engage the respective holes provided in the side plate 53 to fit the first developing unit 31 onto the side plate 53 and, thus, position the first developing unit 31 with respect to the side plate 53. Next, the holes provided in the side plate 81 which is mounted on the front side of the first developing unit 31 fit into the pins 80 provided on the side wall 78, thus positioning the first developing unit 31 with respect to the side wall 78. After that, the protruding portion 89 of the slide 42 is engaged with the cut-out portion 90 of the guide rail 41 to complete the setting of the first developing unit 31 in the body 11. Thus, the first developing unit 31 is mounted so that it is movable with respect to the photosensitive drum 20 by the action of the cam mechanism as previously described.

To remove the second developing unit 32, the second developing unit 32 is first placed in the retracted position. Then, by pulling the side plate 82 shown in FIG. 5 toward the front side, the entire second developing unit 32 is drawn out toward the front side with the slides 51 and 52 being guided respectively by the guide rails 49 and 50. On the other hand, to mount a fresh second developing unit 32 in the body 11, the slide 51 is made to engage the insertion guide rail 49 while engaging the slide 52 with the guide rail 50, and then, the fresh second developing unit 32 is inserted through the insertion opening 79 provided in the side wall 78. When the second developing unit 32 is inserted, the slide 51 engages the cut-out portion 91 of the guide rail 49, while the slide 52 slides on the guide groove 92 of the guide rail 50 to be positioned in the innermost portion of the guide groove 92 where the inside wall is eliminated, thus completing the setting of the second developing unit 32 in the body 11. Thus, the second developing unit 32 is mounted so that it is movable with respect to the photosensitive drum 20 by the action of the cam mechanism 37 as previously described.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A multi-color developing device for an image forming apparatus having a photosensitive drum comprising:

a first developing unit retractable with respect to the photosensitive drum;

a second developing unit adjacent to said first developing unit and retractable with respect to the photosensitive drum;

a cam means for bringing one of said first developing unit and said second developing unit in position adjacent to the photosensitive drum;

a pair of driving gear means provided between said first and second developing units for receiving power to drive said respective developing units;

a first joint gear means for engaging one of said driving gear means to transmit power to said first developing unit;

a second joint gear means for engaging one of said driving gear means to transmit power to said second developing unit;

a first joint member means for rotatably supporting said first joint gear means and for moving said first joint gear means to the position to engage with or disengage from said corresponding driving gear means in synchronization with the moving of said first developing unit close to or away from the photosensitive drum;

a second joint member means for rotatably supporting said second joint gear means and for moving said second joint gear means to the position to engage with or disengage from said corresponding driving gear means in synchronization with the moving of said second developing unit close to or away from the photosensitive drum; and supporting means for supporting said first and second developing units, said supporting means being retractable with respect to the photosensitive drum.

2. A multi-color developing device for an image forming apparatus according to claim 1, wherein each of said first and second joint member means is swingably supported on said corresponding supporting means.

3. A multi-color developing device for an image forming apparatus according to claim 2, further comprising an urging means for urging each of said first and second joint means to engage said corresponding driving gear means, said urging means being disposed between each of said first and second joint member means and said corresponding supporting means.

4. A multi-color developing device for and image forming apparatus according to claim 3, wherein each of first and second joint member means is swung, abutting against a corresponding abutting member and resisting the urging force of said urging means, to disengage said first or second joint gear means from said corresponding driving gear means when one of said first developing unit and said second developing unit is moved to a position remote from the photosensitive drum by an action of said corresponding supporting means.

5. A multi-color developing device for an image forming apparatus according to claim 4, wherein each of said first and second joint member means is positioned so that each of said first and second joint gear means is put in the proper state of engagement with said corresponding driving gear means when one of said first and second joint gear means and said corresponding driving gear means are engaged with each other.

6. A multi-color developing device for an image forming apparatus according to claim 1, wherein each of said first and second developing units is mounted in and removed from the body of the image forming apparatus by sliding in the axial direction of the photosensitive drum.

7. A multi-color developing device for an image forming apparatus according to claim 6, wherein the body of the image forming apparatus is provided with guide rails extending in the axial direction of the photosensitive drum for guiding said first and second developing units, respectively, each said developing unit having a slide which engages said corresponding guide rail, said slide being movable with respect to said corresponding guide rail in both directions to close and widen the distance to the photosensitive drum when each said developing unit is mounted in the body of the image forming apparatus.

* * * * *